US005648326A

United States Patent [19]

Sramek

[11] Patent Number: 5,648,326

[45] Date of Patent: Jul. 15, 1997

[54] LAUNDRY PRE-SPOTTER WITH ASSOCIATIVE POLYMERIC THICKENER

[75] Inventor: John A. Sramek, Racine County, Wis.

[73] Assignee: S. C. Johnson & Son, Inc., Racine, Wis.

[21] Appl. No.: 600,561

[22] Filed: Feb. 12, 1996

Related U.S. Application Data

[63] Continuation of Ser. No. 245,335, May 17, 1994, abandoned.

[51] Int. Cl.[6] ..... C11D 3/37; C11D 1/72; D06M 15/00; D06M 15/263

[52] U.S. Cl. ..... 510/284; 510/421; 510/434; 510/435; 510/476

[58] Field of Search ..... 510/284, 337, 510/339, 356, 361, 421, 434, 435, 476

[56] References Cited

U.S. PATENT DOCUMENTS

| | | | |
|---|---|---|---|
| 3,485,915 | 12/1969 | Gerstein et al. | 424/81 |
| 3,619,119 | 11/1971 | Felletschin et al. | 8/137 |
| 3,652,497 | 3/1972 | Junas et al. | 525/328.8 |
| 3,741,902 | 6/1973 | Barrett, Jr. | 252/90 |
| 4,351,754 | 9/1982 | Dupré | 524/313 |
| 4,384,096 | 5/1983 | Sonnabend | 526/313 |
| 4,438,009 | 3/1984 | Brusky et al. | 252/90 |
| 4,530,781 | 7/1985 | Gipp | 252/546 |
| 4,595,527 | 6/1986 | Gipp | 252/546 |
| 4,648,987 | 3/1987 | Smith et al. | 252/559 |
| 4,909,962 | 3/1990 | Clark | 252/547 |
| 5,057,241 | 10/1991 | Merritt et al. | 252/174.17 |
| 5,186,856 | 2/1993 | Holland | 252/143 |
| 5,205,960 | 4/1993 | Kristopeit et al. | 252/174.24 |
| 5,221,496 | 6/1993 | Holland | 252/143 |
| 5,277,708 | 1/1994 | Stuart, Jr. | 106/8 |
| 5,399,285 | 3/1995 | Kanluen | 252/174.23 |

FOREIGN PATENT DOCUMENTS 0 595 590 5/1994 European Pat. Off. .

OTHER PUBLICATIONS

*Associative Thickeners,* (Handbook Coat. Addition) Schaller and Sperry, Dekker, N.Y., N.Y. (1992) vol. 2, pp. 105–163.

Rohm & Haas Data Sheet No. FC–115a, "Acusol® 820 Stabilizer Thickener for use in Household and Industrial Cleaners," Apr., 1992, 12 pages (Acusol 820 II).

"Urethane—Functional Alkali–Soluble Associative Latex Thickeners," G. D. Shay and A. F. Rich, Journal of Coatings Technology, vol. 58, No. 732, pp. 43–53.

Acrysol ICS–1 Thickener, Rohm and Haas Company, Aug. 1983.

Acusol™ 820 Associative Thickener, Rohm and Haas Company, Nov. 1990. (Acusol 820 I).

Acusol™ Thickeners for Detergents, Rohm and Haas Company, 1990 (no month available).

Acusol™ 810 Acrylic Thickener–Stabilizer, Rohm and Haas Company, 1990 (no month available).

Acusol™ 840 Acrylic Thickener–Stabilizer, Rohm and Haas Company, 1990 (no month available).

Data Sheets on Acusol™ 810, 820, 830 and 840 thickeners, Rohm and Haas Company, Feb. 1, 1991.

Acusol™ detergent polymers—physical properties and general application, Rohm and Haas Company, Apr. 1991.

*Primary Examiner*—Ardith Hertzog

[57] ABSTRACT

The present invention provides laundry pre-spotter compositions with superior cleaning efficacy using associative polymeric thickeners to synergistically boost cleaning. Cleaning efficacy equivalent to compositions comprising having twice the amount of a nonionic surfactant by weight and a viscosity to about 100,000 cps at 25° C. is obtained by employing a composition comprising from about 12.5% to about 13.0% by weight of at least one nonionic surfactant having an average HLB of from about 8 to about 13 and about 0.4% to about 2.0% by weight of at least one associative polymeric thickener.

34 Claims, No Drawings

LAUNDRY PRE-SPOTTER WITH ASSOCIATIVE POLYMERIC THICKENER

This is a continuation of application Ser. No. 08/245,335 filed on May 17, 1994, now abandoned.

FIELD OF THE INVENTION

This invention relates to laundry detergents, specifically pre-wash treatment compositions which effectively remove oily or greasy stains from household clothing articles.

BACKGROUND ART

Common laundry detergents are deficient in handling soil resulting from protein sources, e.g., grass; blood; or soil where the proteins are combined with oils or greases from animal or vegetable origin; or soils of heavy grease; fats or starch origin. In order to effectively remove these difficult soils, various compositions are being sold as "pre-spotters" or "pre-washes." Such compositions are applied directly to difficult stains before the normal washing process.

Current pre-spotters are generally formulated with high concentration of surfactants required to obtain good cleaning. Due to possible environmental concerns and costs relating to the use of certain surfactants, there is a need to reduce the surfactant content in cleaning compositions. However, it has proven difficult for the industry to formulate cleaning compositions with reduced surfactant content which maintain the cleaning efficacy of current pre-spotters and which also possess other desired properties such as optimal viscosity, fragrance and ease of use.

Therefore, it is an object of the present invention to provide a laundry pre-spotter composition having a low surfactant content which exhibits equivalent cleaning performance of compositions having significantly higher amounts of surfactants.

It is a further objective of the invention to provide a laundry pre-spotter composition that is easy to use with sufficient thickness so that it will remain on the stained area before laundering.

SUMMARY OF THE INVENTION

The present invention achieves the objectives enumerated above by providing a pre-spotter composition comprising from about 0.4% to about 2.0% by weight of at least one associative thickener and from about 5.0% to about 30% by weight of at least one nonionic surfactant having an average HLB of from about 8 to about 13.

Advantageously, these formulations may be sprayed from a trigger pump or aerosol spray package, yet will re-thicken upon contact with the fabric to be treated so the pre-spotter will not drip off the fabric before being placed into the wash.

DETAILED DESCRIPTION OF THE INVENTION

The present invention relates to novel laundry pre-spotter compositions which unexpectedly provide equivalent cleaning efficacy of compositions containing twice as much by weight of nonionic surfactants. These compositions also possess theological characteristics which allows them to be readily sprayed but will re-thicken upon contact with the fabric. Laundry pre-spotters of the present invention generally comprise from about 5.0% to about 2.0% by 30% by weight of nonionic surfactant and from about 0.4% to about 2.0% by weight of an associative thickener.

Associative thickeners are water-soluble or water swellable polymers that have chemically attached hydrophobic groups that are capable of non-specific hydrophobic associations similar to those of conventional surfactants. They are also known as hydrophobically modified water soluble polymers.

Associative thickeners have traditionally been used in latex paint technology as rheological altering material. See, *Associative Thickeners*, (Handbook Coat. Addition) Schaller and Sperry, Dekker, New York, N.Y., (1992) Vol. 2, pp. 105–63.

Associative thickeners have also been used in liquid soap compositions for altering the rheology of the compositions. For example, in U.S. Pat. No. 5,057,241 to Merritt et at., ACRYSOL™ ICS-1 thickeners are utilized to alleviate post-use dripping problems of liquid hand soaps from soap dispensing units. The combination of anionic surfactants with the associative thickener provides the '241 formulations with viscosity control and sheer quality. However, the '241 patent does not teach or suggest improved cleaning efficacy of soaps with the addition of an associative thickener to nonionic surfactants. The '241 patent also does not teach or suggest that the composition of the present invention may be effective as an laundry pre-spotter.

Unexpectedly, a synergistic cleaning effect is achieved by the combination of nonionic surfactants and associative thickeners, as associative thickeners typically do not provide any cleaning efficacy alone. Rohm & Haas Data Sheet No. FC- 115a, entitled "Acusol® 820 Stabilizer Thickener for use in Household and Industrial Cleaners"; April, 1992, 12 pages, for the associative thickener Acusol® 820 does not suggest any cleaning synergetic benefits from the combination of Acusol® 820 and nonionic surfactants in commercial laundry detergents.

The associative thickeners utilized in the present invention are water soluble and impart pseudo plastic characteristics to the laundry pre-spotter composition after the polymer is neutralized to a pH of 5.5 or more. Such associative thickeners are generally supplied in the form of an acidic aqueous emulsion or dispersion. The polymers thicken aqueous solutions when the carboxyl groups present are neutralized to a point where the pH of the solution is about 5.5 or greater.

The associative thickener is typically an addition polymer of three components: an alpha-beta-monoethylenically unsaturated monocarboxylic acid or dicarboxylic acid of from 3 to 8 carbon atoms such as acrylic acid or methacrylic acid to provide water solubility, a monoethylenically unsaturated copolymerizable monomer lacking surfactant capacity such as methyl acrylate or ethyl acrylate to obtain the desired polymer backbone and body characteristics, and a monomer possessing surfactant capacity which provides the pseudo plastic properties to the polymer and is the reaction product of a monoethylenically unsaturated monomer with a nonionic surfactant compound wherein the monomer is copolymerizable with the foregoing monomers such as the reaction product of methacrylic acid with a monohydric nonionic surfactant to obtain a monomer such as $CH_3(CH_2)_{15-17}(OCH_2CH_2)_eOOCC(CH_3)=CH_2$ where "e" has an average value of about 10 or 20. Optionally, up to about 2.0% of a polyethylenically unsaturated monomer sloth as ethylene glycol diacrylate or dimethacrylate or divinylbenzene can be included if a higher molecular weight polymer is desired.

Additional associative thickeners include maleic anhydride copolymers reacted with nonionic surfactants such as ethoxylated $C_{12}$–$C_{14}$ primary alcohol available under the trade name Surfonic L Series from Texaco Chemical Co. and Gantrez AN-119 from ISP.

Preferably, the associative thickeners include $C_{10-C22}$ alkyl groups in an alkali-soluble acrylic emulsion polymer such as those available under the trademark "Acusol®" from Rohm and Haas Co. of Philadelphia, Pa. The most preferred associative thickeners are Acusol® 820 ("820") and 1206A ("1206A"). Acusol® 820 is a 30.0% active emulsion polymer of 40.0% methacrylic acid, 50% ethyl acrylate and 10.0% stearyl oxypoly ethyl methacrylic emulsion polymer having approximately 20 moles of ethylene oxide. It appears that 1206A is a 30% active emulsion polymer with 44% methacrylic acid, 50% ethyl acrylate and 6% stearyl methacrylate polymer having about 10 moles of ethylene oxide. These polymers are described in U.S. Pat. No. 4,351,754 to Dupre.

The associative thickener is typically used in an amount of about 0.4% to about 2.0% by weight, more preferably is present in an amount of about 0.75% to about 1.5% by weight and most preferably present in an amount of about 0.9% to about 1.3% by weight, based on the total weight of the composition. Mixtures of associative thickeners may be used to obtain the desired rheological characteristics of a pre-spotter composition. This allows the formulations to be sprayed from all aerosol spray package or trigger pump and rethicken upon contact with the article to be laundered without messy dripping. A viscosity of from about 500 cups to about 100,000 cps at 25° C. is achievable and useful.

Suitable nonionic surfactants tier use in the present invention include ethoxylated long chain alcohols, propoxylated/ethoxylated long chain alcohols; such as poly-tergents from Olin Corp. and Plurafac from BASF Corp.; ethoxylated nonylphenols, such as the Surfonic N Series available from Texaco; the ethoxylated octylphenols, including the Triton X Series available from Rohm & Haas; the ethoxylated secondary alcohols, such as the Tergitol Series available from Union Carbide; the ethoxylated primary alcohols series, such as the Neodols available from Shell Chemical; and the ethylene oxide propylene oxide block copolymers, such as the Pluronics available from B.A.S.F. and mixtures thereof While all such nonionics are useful in the present invention, those nonionics and mixtures of nonionics having an average HLB in the range from about 8 to about 13 are preferred. The most preferred surfactants include the ethoxylated secondary alcohols and the ethoxylated primary alcohols, as these materials have excellent oil and water dispensability, good detergency characteristics and have good biodegradability. The particularly preferred surfactants are secondary alcohols having from 5 to 7 moles of ethylene oxide, and particularly, secondary alcohols having 5 moles of ethylene oxide which are available from Union Carbide under the trademark "Tergitol 15-5-5".

Additional preferred nonionic surfactants include ethoxylated mono and di-glycerides, for example, ethoxylated tallow mono glyceride, available under the tradename "Varionic LI42" from Witco Corp.; and primary alcohol ethoxylates, particularly, primary alcohols having 5 moles of ethylene oxide which are available under the tradename Surfonic L24-5 from Texaco or Neodol 23-5 from Shell Oil Corp. Further preferred surfactants include short primary alcohol propoxylated and then ethoxylated such as Poly-Tergent SL-15 from Olin Chemical Co.

Other similar nonionic surfactants can be substituted for the aforementioned surfactants in the pre-spotters of the present invention so long as they meet the criteria set forth above.

Generally, the composition should include from about 5.0% to about 30.0%, preferably from about 10.0% to about 16.0%, and most preferably, from about 12.5% to about 13.0% by weight of at least one nonionic surfactant.

Amphoteric surfactants may also be added to the compositions of the present invention to improve the removal of dirt and oil based stains. One preferred surfactant is tallow amidopropyl hydroxylsulfobetaine available under the tradename Crosultaine T-30 from Croda, Inc. Additional amphoteric surfactants include glycinates and diglycinates such as tallow diglycinate, available from Witco Corp. under the trade name Sherex EPSC-191. Amphoteric surfactants are generally used in amounts from about 0% to about 3.0%, preferably, about 1.0% by weight of the composition.

Solvents may also be used with the laundry pre-spotters of the present invention to improve stain removal of oil and grease based stains. Suitable solvents includes alpha-olefins such as tetradecene, low molecular weight non-VOC polybutane, dipropyleneglycol methyl ether, N-(n-Octyl)-2-Pyrrolidone and mixtures thereof. Tetradecene is available under the trade name Neodene 14 from Shell Oil Corp. or the trade name Gulftene 14 from Chevron Oil Corp. The low molecular weight non-VOC polybutene solvent is available under the trademark Indopol L14 from Amoco Chemical Co. Dipropyleneglycol methyl ether is available from Dow Chemical under the trademark Dowanol DPM. N-(n-Octyl)-2-Pyrrolidone is available from ISP Corp. under the trademark Surfadone LP- 100.

The above described solvents are typically used in an amount from about 0% to about 3.0% by weight of the pre-spotter compositions.

Chelating agents, especially the EDTA, DTPA, and HEDTA types, can also be added to the composition of the present invention to assist in complexing heavy metal ions during the laundering process. The salt form of the chelating agent, is preferred since the salts are water soluble. If the chelating agents are added in the water insoluble free acid form, the free acids must be at least partially neutralized to make them water soluble and form the chelating agent salts in situ. Suitable bases to neutralize the free acids are sodium hydroxide, potassium hydroxide and ammonium hydroxide. Sufficient base is added to solubilize the free acid chelating agent and to bring the pH of the composition within the range of about 4.5 to 12.2.

If the chelating agents are added as salts, these salts are often quite basic, having a pH often above 10. It may be necessary to add some acid or other pH buffering material to the composition of the present invention to adjust the pH to within a range of from 4.5 to 12.2 and preferably 6.5 to 8.5. Suitable acids include citric acid, oxalic, acid, acetic acid, hydrochloric acid, phosphoric, and the like. The primary function of the acid is to control the pH so that the chelating agent and the surfactants can remove the stains from the fabrics. Certain organic acids also have some chelating properties and therefore may contribute to the overall cleaning efficiency of the pre-spotting compositions. Generally, the acids, if used, are present in the compositions in the amount of from 0.2% to 2.0% by weight. The preferred acid is citric acid.

Citric acid may also be employed as a chelating agent, since it possesses chelating properties. For this purpose it is employed in chelating amounts from about 0.5% to about 4.0% by weight and, preferably, from about 0.75% to about 3.0% by weight. A suitable base can be employed to adjust the pH of the composition to within the preferred range from about 6.0 to about 9.0.

Accordingly, citric acid may be employed herein as a first component of the inventive composition to assist in removing heavy metal and hard water ions and/or to act in concert with the nonionic surfactant to aid in attacking stains. If desired, citric acid is also employed in combination with other chelating agents of the inventions, to assist in controlling the final pH of the composition, when such other chelating agents are added as salts.

Builder polymers may also be added lo the present pre-spotter invention to improve stain removal of certain stains. Generally, the builder polymers include co-polymers of acrylic acid and maleic acid. One example of a builder polymer is Acusol® 505N which is available from Rohm & Haas. Acusol® 505N is an acrylic acid/maleic acid co-polymer having a molecular weight of 40,000 at 35% N.V. Builder components are generally added in amounts from about 0% to about 1.0%, preferably from about 0.1% to about 0.5%, and most preferably about 0.2% by weight of the compositions.

Other components may be added which allow the laundry pre-spotter compositions of the present invention to be utilized more effectively in a variety of water conditions. For soft-water conditions, solvents such as Surfadone LP 100, available from ISP Corp., may be added in amounts of from about 0.1% to about 2.0%, preferably about 0.5% by weight. For hard water conditions, amphoteric surfactants such as glycinates and diglycinates may be added for improved cleaning. For example, tallow diglycinate, available from Witco Corp. under the tradename Sherex EPSC-191 may be added in amounts of from about 1.5% to about 0% preferably about 0.5% by weight.

Soil release agents, such as the Sokalan® HP Series available from B.A.S.F. Wyandotte, may also be added, which possess soil repellancy properties. Surprisingly, this polymer also assists in removing stains the first time the laundry pre-spotter composition is utilized on an article of clothing. Preferably, the soil release agent is Sokalan® HP22. The soil release agent is typically present in an amount from about 0% to about 2.0%, preferably about 0.75% by weight of the pre-spotter compositions.

The compositions may also include enzymes to assist in the removal of protein based stains such as grass and blood stains. The preferred enzymes are available under the trademark Durazym from Novo Nordisk Bioindustrials Inc. Enzymes are typically present in an amount from about 0% to about 1.0% by weight of the pre-spotter compositions.

The compositions of the present invention also generally include water. Water is the filler or bulk medium and also enables cleaning of water-borne stains. The water is present in an amount of from about 95.0% to about 5.0% by weight, preferably from about 90.0% to about 30.0% by weight, and most preferably from about 80.0% to about 35.0% by weight of the compositions.

In addition to the above components, the compositions of the present invention may include a number of optional ingredients such as perfumes, dyes, optical brighteners, salts and solvents to control viscosity, hydrogen peroxide, corrosion inhibitors, defoamers, bactericides, bacteriostats, and the like. These materials are generally present in amounts of less than about 5.0% by weight of the pre-spotter composition. A particular, preferred aqueous laundry pre-spotter composition made in accordance with the invention includes from about 5.0% to about 30.0% by weight of the total composition of at least one nonionic surfactant having an average HLB value of from about 8 to about 13. This preferred composition also includes from about 0.4% to about 2.0% by weight of the total composition of a hydrophobically modified water soluble polymer thickening agent which, when neutralized to a pH of at least 5.5, is water soluble and imparts pseudo-plastic and synergistic cleaning characteristics to the detergent composition. The polymer is an addition polymer prepared from monomers comprising (i) at least one $C_3$–$C_8$ alpha-beta monoethylenically unsaturated monocarboxylic acid or dicarboxylic acid monomer; (ii) at least one monoethylenically unsaturated copolymerizable monomer lacking surfactant capacity; and (iii) at least one monomer possessing surfactant capacity that is the reaction product of a monoethylenically unsaturated monomer with a nonionic surfactant compound wherein the monomer is copolymerizable with the monomers of (i) and (ii). The composition also includes an effective amount of an alkaline neutralizing agent to neutralize the polymer component just described and adjust the pH of the composition to from about 5.5 to 9.5. The composition so disclosed provides cleaning effectiveness equivalent to a composition containing about twice the amount of nonionic surfactant by weight. The composition exhibits a viscosity of from about 500 cps to about 100,000 cps at 25° C.

The nonionic surfactant of the laundry pre-spotter composition just described may usefully be a secondary alcohol ethoxylate having from about 5 moles ethylene oxide.

It is also further preferred that the acid monomer of the laundry pre-spotter composition just described be selected from the group consisting of acrylic acid and methacrylic acid. It is also preferred that the monoethylenically unsaturated copolymerizable monomer lacking surfactant capacity be selected from copolymerizable monomers of the formula $H_2C{=}CYZ$ wherein (a) Y is H, and Z is —$COOR^1$, —$C_6H_4R^2$, CN, —$OOCR^3$, or —$CONH_2$; or (b) Y is $C_1$–$C_4$ alkyl, and Z is —$COOR^1$, —$C_6H_4R^2$, CN or —$CONH_2$; and $R^1$ is $C_1$–$C_8$ alkyl; $R^2$ is H or $C_1$–$C_4$ alkyl; and $R^3$ is $C_1$–$C_8$ alkyl. It is further preferred that the polymer component of the laundry pre-spotter composition include about 30% to 60% of the acid monomer; about 15% to 80% of the monoethylenically unsaturated copolymerizable monomer lacking surfactant capacity; and about 4.0% to 20% of a surfactant ester of the formula:

$$H_2C{=}CR^4CO(OC_2H_4)_n(OCHR^5CH_2)_mOR^6$$

wherein $R^4$ is H or $CH_3$, each $R^5$ is $C_1$–$C_2$ alkyl, $R^6$ is $C_8$–$C_{30}$ alkyl or $C_8$–$C_{16}$ alkylphenyl 7, n has an average value of from about 3–40 and m has an average value of from about 0–40 provided that n is greater than or equal to m and the sum of n+m is about 3–80.

It is preferred that the alkaline neutralizing agent of the laundry pre-spotter composition be selected from the group consisting of sodium hydroxide, potassium hydroxide, ammonium hydroxide and mixtures thereof. It is also preferred that the nonionic surfactant be present in an amount of from 12.5% to about 13.0% by weight of the total composition. It is further preferred that the polymer component be present in an amount from about 0.75% to about 1.5% by weight of the total composition and, even more preferred, that the polymer be present in an amount of from about 0.9% to about 1.3% by weight of the total composition.

Although the compositions of the present invention are primarily designed for use as pre-spotting compositions, these compositions can also be used as heavy duty liquid laundry detergents or hard surface cleaning agents.

The compositions of the present invention are also suitable for use in aerosol compositions. Typical aerosol compositions include from about 80.0% to about 95.0% by weight of the composition of the present invention and from about 5.0% to about 20.0% by weight of a propellant. Any of the typical aerosol propellants, such as hydrocarbon, halogenated hydrocarbon and compressed gasses, can be used. Suitable propellants include propane, butane, isobutane, pentane, propellant 11, propellant 12, propellant 14, and the like. Preferred propellants are the hydrocarbon propellants as other propellants may interact with the water to cause corrosion problems.

The compositions of the present invention can be prepared by any conventional means. Suitable methods include cold blending or other mixing processes. It is not necessary to use high shear or other strenuous mixing techniques to prepare the compositions of the present invention.

The pre-spotting compositions of the present invention will now be illustrated by the following examples, wherein all parts and percentages are by weight and all temperatures in degree Celsius unless otherwise indicated.

EXAMPLES 1–18

Liquid pre-spotting compositions were prepared by cold blending the following ingredients:

| | |
|---|---|
| Nonionic surfactant (listed below in Table A) | 13.0% |
| Acusol 820 ® (30% as emulsion) | 3.0 |
| Deionized water | 82.0 |
| 5% NaOH | 2.0 |
| | 100.0% |

TABLE A

| | Nonionic Surfactant | Appearance | Viscosity | % Cleaning |
|---|---|---|---|---|
| 1. | Secondary Alcohol (5 Moles EO) (Tergitol 15-5-5) | Translucent | Gel >100,000 cps | 40.96 |
| 2. | Ethoxylated Alcohol (4 Moles EO) (surfonic L24-4) | Opaque | Stiff Gel >100,000 cps | 23.94 |
| 3. | Ethoxylated Alcohol (5 Moles EO) (Surfonic L24-5) | Opaque | Liquid | 25.23 |
| 4. | Linear Ethoxylated Alcohol (6.8 Moles EO) (Surfonic L45-55) | Opaque | Gel >100,000 cps | 12.91 |
| 5. | Linear Ethoxylated Alcohol (7 Moles EO) (Surfonic L46-7) | Clear | Liquid >100,000 cps | 22.84 |
| 6. | 4.3% L46-7 + 8.7% L46-55 | Opaque | Gel >100,000 cps | 16.17 |
| 7. | $C_{14}$–$C_{15}$ Linear Primary Alcohol Ethoxylate (7 Moles EO) (Neodol 45-7) | Clear | Near Gel | 18.55 |
| 8. | $C_{14}$–$C_{15}$ Linear Primary Alcohol Ethoxylate (7 Moles EO) (Narrow Range) (Neodol 45-7T) | Clear | Liquid | 19.40 |
| 9. | $C_{12}$–$C_{13}$ Linear Primary Alcohol Ethoxylate (5 Moles EO) (Neodol 23-5) | Opaque | Liquid | 24.85 |
| 10. | $C_{12}$–$C_{13}$ Linear Primary Alcohol Ethoxylate (6.5 Moles EO) (Narrow Range) (Neodol 23-6.5T) | Clear | Thick Liquid | 8.89 |
| 11. | $C_{11}$ Linear Blend of 7 EO and 3 EO (Neodol (6%) 1–7 + (7%) 1–3) | Opaque | Near Gel | 19.33 |
| 12. | Fatty Alcohol Polyglycol Ether (5 Moles EO) (Genapol 26-L-5) | Opaque | Liquid | 20.93 |
| 13. | Fatty Alcohol Polyglycol Ether (6 Moles EO) (Genapol X60) Tridecyl Alcohol | Opaque | Liquid | 18.71 |
| 14. | Fatty Alcohol Polyglycol Ether (8 Moles EO) (Genapol T-080) Tallow Alcohol | Opaque | Pearly Gel | 7.06 |
| 15. | $C_9$ to $C_{11}$ Primary Alcohol Ethoxylate (5.5 Moles EO) (Narrow Range) (Berol 266) | Clear | Thick Liquid | 12.96 |
| 16. | $C_{12}$–$C_{16}$ Linear Primary Alcohol (7 Moles EO) (Narrow Range) (Novel II 1216-58) | Clear | Liquid | 15.26 |
| 17. | $C_{12}$–$C_{16}$ Linear Primary Alcohol (5 Moles EO) (Narrow Range) (Novel II 1216-42) | Translucent | Gel >100,000 cps | 30.85 |
| 18. | 8.3% 1216-58 + 4.7% 1216-42 | Clear | Liquid | 19.96 |

EXAMPLES 19–25

Liquid pre-spotting compositions were prepared by cold blending the following ingredients:

| Example | % Nonyl-phenol 6-EO | % Water | Polymer | % Cleaning |
|---|---|---|---|---|
| Comparative Ex. 19 | 10% | 90% | 0 | 9.7 |
| Comparative Ex. 20 | 30 | 70 | 0 | 24.8 |
| 21 | 10 | 87 | 3.0 Acusol ® 820 | 26.3 |
| 22 | 10 | 87 | 3.0 Acusol ® 1206A | 25.9 |
| Comparative Ex. 23 | 100 | 0 | 0 | 27.0 |
| Comparative Ex. 24 | No Prespotter, Tide alone in wash | | | 3.2 |
| Comparative Ex. 25 | Standard PreSpotter | | | 13.0 |

As the standards, Tide® laundry detergent (Ultra, Powder) manufactured by Procter & Gamble and a standard laundry pre-spotter formulation prepared under Example #9 of U.S. Pat. No. 4,595,527 ("standard pre-spotter"), were used. The standard pre-spotter had the following formulation:

| Material | % by wt. |
|---|---|
| Water | 86.09 |
| Nonylphenol (6 moles EO) | 10.00 |
| 50% Citric Acid | 2.40 |
| 50% NaOH | 1.51 |
| | 100.00 |

The liquid pre-spotting compositions (Examples 1–23), and the standard pre-spotter composition (Example 25) were applied to stains using 2 cc plastic droppers. The formulations were tested on 10 cm×10 cm white cloth swatches of 65/35 polyester/cotton. Two drops of used motor oil was applied to each swatch. The oil was allowed to wick out overnight. The test swatches were washed the next day or placed into a freezer until needed. The swatches were saturated with 2 cc of the above formulations and allowed to sit for about five minutes.

Each stained fabric swatch was then machine washed using a Kitchen Aid Washer model AW560W, new in 1992. Twenty-four test swatches were washed in the same machine wash load, using one level scoop of Ultra Tide Powder, (0 phosphorus), at a 37° C. ten minute wash and 21° C. rinse. The water had about 90 ppm hardness From the Racine city water supply. No towels or dummy load was used. The swatches were dried in a standard clothes dryer for ten minutes on low heat, and were removed before the dryer shut off.

Using the Hunterlab Visual Index ("HVI"), read "L" and Whiteness Index ("W.I".) of each stain before and after washing and the white unstained cloth. Two readings were taken from each stain and the Hunterlab calculated the mean value for each stain. The backing plate on the Hunterlab was a piece of white Formica. The cleaning for each swatch was calculated using the following equations:

$$\text{Hunter Visual Index (HVI)}=(W.I.\times L)/100$$

$$\%\ \text{Cleaning}=[(C-D)/(W-D)]\times 100$$

C=HVI of stain after washing

D=HVI of stain before washing

W=HVI of unstained white cloth

The results for Examples 1–25 are tabulated above in the "% Cleaning" column. Using the standard pre-spotter, (Comparative Example 25), a cleaning score of 13, as a basis, a majority of the nonionic surfactants tested achieved a score of about 13 or better. Comparing Example 20, which is 30% surfactant, to Examples 21 and 22, it is seen that the addition of about 0.9% of an associative thickener to certain nonionic surfactants produced laundry pre-spotter formulations having cleaning efficiency on used motor oil at least equivalent to a pre-spotter having at least about twice the amount of nonionic surfactant by weight.

EXAMPLE: 26

The preferred composition of the present invention was prepared by cold blending the following ingredients at room temperature:

| Material | % by wt. |
|---|---|
| Deionized Water | 70.626 |
| Disodium EDTA (Chelating Agent) | 0.200 |
| Tergitol 15-S-7 | 2.640 |
| Tergitol 15-S-5 | 5.360 |
| Poly-Tergent SL-22 | 3.000 |
| 50% Citric Acid | 2.000 |
| Acusol ® 505N | 0.500 |
| Sokalan HP22 | 0.750 |
| Acusol ® 1206A | 2.000 |
| Acusol ® 820 | 3.000 |
| Indopol L14 | 1.500 |
| Dowanol DPM | 4.000 |
| Varonic LI42 | 0.400 |
| Sherex EPSC 352-191 | 0.500 |
| Crosultain T-30 | 0.500 |
| Surfadone LP-100, ISP | 0.500 |
| 50% NaOH solution (to pH 7.1–7.4) | 1.800 |
| 0.1% solution of FD&C Blue #1 | 0.100 |
| Perfume | 0.200 |
| Fungicide | 0.004 |
| Enzymes | 0.004 |
| | 100.000 |

A cleaning score of about 42.84% was achieved with this formulation calculated by the HVI test method used in EXAMPLES 1–25. It has a viscosity of 4,350 cps at 25° C.

EXAMPLE 27

One further embodiment of the present invention was prepared by cold blending the following components at room temperature:

| Material | % by wt. |
|---|---|
| Deionized Water | 36.126 |
| Disodium EDTA | 0.300 |

-continued

| Material | % by wt. |
|---|---|
| Sodium Citrate | 0.750 |
| Tergitol 15-S-7 | 14.700 |
| Tergitol 15-S-5 | 12.000 |
| Dowanol DPM | 4.000 |
| Acusol ® 820 | 5.000 |
| Neodene 14 | 26.000 |
| 0.1% solution of FD&C Blue #1 | 0.100 |
| Fungicide | 0.004 |
| Perfume | 0.200 |
| 20% NaOH solution (to pH 7.0) | 0.420 |
| Enzymes | 0.400 |
| | 100.000 |

A cleaning score of about 71.07% was achieved with this formulation calculated by the HVI test method used in EXAMPLES 1–25. A cleaning score of only 27.0% was achieved with a 100% nonionic surfactant composition (See Comparative Example 23 ). The above composition also demonstrates a viscosity of 1,800 cps at 25° C.

EXAMPLES 28–35

Oil Removal Cleaning Study

| | 28 | 29 | 30 | 31 | 32 | 33 | 34 | 35 |
|---|---|---|---|---|---|---|---|---|
| Olin Poly-Tergent SL-15 | 10.0 | — | — | — | — | — | — | — |
| Olin Poly-Tergent SL-42 | — | 10.0 | — | — | — | — | — | — |
| Surfonic N-40 | — | — | 10.0 | — | — | — | — | — |
| Surfonic N-60 | — | — | | 10.0 | — | 7.0 | 13.0 | 16.0 |
| Surfonic N-85 | — | — | — | — | 10.0 | — | — | — |
| R & H Acusol ® 1206A | 3.0 | 3.0 | 3.0 | 3.0 | 3.0 | 3.0 | 3.0 | 3.0 |
| Deionized Water | 86.0 | 86.0 | 86.0 | 86.0 | 86.0 | 89.0 | 83.0 | 80.0 |
| 20% NaOH to pH 7.0 | | | | | | | | |

The compositions were prepared and tested by the HVI method described in Examples 1–25. The cleaning scores were as follows:

TABLE B

| Ref. | % Cleaning |
|---|---|
| 28 | 14.20 |
| 29 | 7.99 |
| 30 | 11.14 |
| 31 | 24.99 |
| 32 | 14.20 |
| 33 | 22.38 |
| 34 | 26.93 |
| 35 | 23.80 |
| Standard Pre-spotter | 12.28 |
| Tide ® alone | 4.78 |

As shown from the cleaning scores above, several of the compositions screened achieved a cleaning score equivalent to twice that of the standard pre-spotter.

EXAMPLES 36A–49B:

Cleaning Study on Used Motor Oil

Liquid pre-spotting compositions were prepared by cold blending the following ingredients:

| Ingredient | % |
|---|---|
| Surfactant | 13.0 |
| Polymer @ 30% | 3.0 |
| Deionized Water | 84.0 |
| pH 6.5 with NaOH | |

Then each composition was tested on a fabric swatch or described in Examples and the percent cleaning was measured using the HVI test described in EXAMPLES 1–25. As standards, Tide® and the nonionic surfactant standard pre-spotter were used.

Cleaning—Used Motor Oil on Blend % Clean (HVI)

| | % Clean (HVI) |
|---|---|
| Standard Pre-spotter (Comparative Example) | 13.98 |
| Tide ® | 3.30 |

| | A % Clean (HVI) Acusol 1206A | Surfactant HLB | B % Clean (HVI) Acusol 820 |
|---|---|---|---|
| 36 Surfonic N60 | 18.94 | 10.6 | 22.83 |
| 37 Surfonic N85 | 11.40 | 9.4 | 19.96 |
| 38 Surfonic L12-3 | 13.69 | 10.9 | 25.45 |
| 39 Surfonic L24-4 | 25.68 | 10.7 | 17.42 |
| 40 Polytergent SL15 | 12.82 | 9.0 | 25.05 |
| 41 Tergitol 15-S-5 | 16.94 | 9.5 | 31.47 |
| 42 Tergitol 15-S-7 | 10.19 | 11.8 | 10.73 |
| 43 Genapol UD-30 | 10.71 | 12.6 | 19.74 |
| 44 Genapol UD-50 | 11.59 | 8.0 | 15.10 |
| 45 Genapol UD-70 | 9.66 | 11.2 | 12.53 |
| 46 Genapol 24-L-45 | 16.23 | 11.0 | 19.95 |
| 47 Alfonic 610-50R | 9.67 | 13.0 | 12.06 |
| 48 Neodol 23-5 | 17.74 | 10.0 | 21.53 |
| 49 Neodol 1-5 | 13.25 | 12.4 | 14.58 |

As shown in the cleaning scores listed above, a majority of the nonionic surfactants screened achieved a score of about 13 or better, especially when Acusol® 820 was the polymer used Thus, the addition of small amounts of associative thickeners with most of the nonionic surfactants listed can provide cleaning efficacy superior to commercially acceptable compositions. (See Comparative Example 25)

Industrial Applicability

Therefore, the laundry pre-spotter composition can be used to economically produce liquid gel or aerosol formulations using reduced nonionic surfactants, which possess equivalent cleaning efficacy as compositions having twice the amount of nonionic surfactants. These compositions are also cost-saving as they require significantly lesser amounts of nonionic surfactants to produce effective laundry pre-spotter compositions.

Other modifications and variations of the present invention will become apparent to those skilled in the art from an examination of the above specification and examples. Therefore, other variations of the present invention may be made which fall within the scope of the appended claims even though such variations were not specifically discussed above.

I claim:

1. An aqueous laundry pre-spotter composition free of abrasive materials and comprising:

(a) From about 5.0% to about 30.0% by weight of at least one ethoxylated nonionic surfactant having an average HLB value of from about 8 to about 13;

(b) From about 0.4% to about 2.0% by weight of at least one associative polymeric thickener wherein the composition provides cleaning equivalent to a composition containing about twice the amount of nonionic surfactant by weight and exhibits a viscosity of from about 500 cps to about 100,000 cps at 25° C.; and (c) Amounts of an alkaline neutralizing agent effective to neutralize the polymer of (b) and adjust the pH of the composition to from 5.5 to 9.5.

2. The laundry pre-spotter composition as claimed in claim 1, wherein the nonionic surfactant is a secondary alcohol ethoxylate having about 5 moles of ethylene oxide.

3. The laundry pre-spotter composition as claimed in claim 1, wherein the associative polymeric thickener is a methacrylate emulsion polymer.

4. The laundry pre-spotter composition as claimed in claim 3, wherein the methacrylate emulsion polymer comprises a 40.0% methacrylic acid/50.0% ethyl acrylate/10.0% stearyl oxypoly ethyl methacrylate emulsion polymer having about 20 moles of ethylene oxide.

5. An aqueous laundry pre-spotter composition free of abrasive materials and comprising:

(a) from about 10.0% to about 16.0% by weight of an ethoxylated nonionic surfactant having an HLB value of about 8 to about 13; and (b) from about 0.75% to about 1.5% by weight of an associative polymeric thickener, wherein the composition provides cleaning efficacy equivalent to a composition having about twice the amount of a nonionic surfactant by weight and exhibits a viscosity of from about 500 cps to about 100,000 cps at 25° C.; and (c) amounts of an alkaline neutralizing agent effective to neutralize the polymer of (b) and adjust the pH of the composition to from 5.5 to 9.5.

6. The laundry pre-spotter composition as claimed in claim 5, wherein the nonionic surfactant is a secondary alcohol ethoxylate having about 5 moles ethylene oxide.

7. The laundry pre-spotter composition as claimed in claim 5, wherein the associative polymeric thickener is a methacrylate emulsion polymer.

8. The laundry pre-spotter composition as claimed in claim 7, wherein the methacrylate emulsion polymer is a 40.0% methacrylic acid/50.0% ethyl acrylate/10.0% stearyl oxypoly methacrylate emulsion polymer having about 20 moles of ethylene oxide.

9. An aqueous laundry pre-spotter composition free of abrasive materials and comprising from about 9.0% to about 13.0% by weight of nonylphenol having a degree of ethoxylation of about 6; and from about 0.9% to about 1.3% by weight of a methacrylate emulsion polymer, 40.0% methacrylic acid/50.0% ethyl acrylate/10.0% stearyl having about 20 moles of ethylene oxide, wherein, the composition provides cleaning efficacy equivalent to a composition containing about twice the amount of nonionic surfactant by weight.

10. An aqueous laundry pre-spotter composition, consisting essentially of:

(a) from about 5.0% to about 30.0% by weight of the total composition of at least one ethoxylated nonionic surfactant having an average HLB value of from about 8 to about 13;

(b) from about 0.4% to about 2.0% by weight of the total composition of a hydrophobically modified water soluble polymer thickening agent which when neutralized to a pH of at least 5.5 is water soluble and imparts pseudo plastic and synergistic cleaning characteristics to the detergent composition and is an addition polymer prepared from monomers comprising (i) at least one $C_3$–$C_8$ alpha-beta monoethylenically unsaturated monocarboxylic acid or dicarboxylic acid monomer; (ii) at least one monoethylenically unsaturated copolymerizable monomer lacking surfactant capacity; and (iii) at least one monomer possessing surfactant capacity which is the reaction product of a monoethylenically unsaturated monomer with a nonionic surfactant compound wherein the monomer is copolymerizable with the monomers of (i) and (ii); and (c) an effective amount of an alkaline neutralizing agent to neutralize the polymer of (b) and render the pH of the composition in the range of about 5.5 to 9.5, wherein the composition provides cleaning equivalent to a composition containing about twice the amount of nonionic surfactant by weight and exhibits a viscosity of from about 500 cps to about 100,000 cps at 25° C.

11. The laundry pre-spotter composition as claimed in claim 10, wherein the nonionic surfactant is a secondary alcohol ethoxylate having about 5 moles ethylene oxide.

12. The laundry pre-spotter composition as claimed in claim 11, wherein the acid monomer (i) is selected from the group consisting of acrylic acid and methacrylic acid and the monomer (ii) is selected from copolymerizable monomers of the formula $H_2C{=}CYZ$ wherein either (a) Y is H and Z is $—COOR^1$, $—C_6H_4R^2$, CN, $—OOCR^3$, or $—CONH_2$; or (b) Y is $C_1$–$C_4$ alkyl and Z is $—COOR^1$, $—C_6H_4R^2$, CN or $—CONH_2$; and $R^1$ is $C_1$–$C_8$ alkyl; $R^2$ is H or $C_1$–$C_4$ alkyl; and $R^3$ is $C_1$–$C_8$ alkyl.

13. The laundry pre-spotter composition as claimed in claim 12, wherein the polymer component comprises about 30% to 60% of monomer (i); about 15% to 80% of monomer (ii); and about 4.0% to 20% of a surfactant ester of the formula $$H_2C{=}CR^4CO(OC_2H_4)_n(OCHR^5CH_2)_mOR^6$$

wherein $R^4$ is H or $CH_3$, each $R^5$ is $C_1$–$C_2$ alkyl, $R^6$ is $C_8$–$C_{30}$ alkyl or $C_8$–$C_{16}$ alkylphenyl 7, n has an average value of from about 3–40 and m has an average value of from about 0–40 provided that n is greater than or equal to m and the sum of n+m is about 3–80.

14. The laundry pre-spotter composition as claimed in claim 10, wherein the alkaline neutralizing agent is selected from the group consisting of sodium hydroxide, potassium hydroxide, ammonium hydroxide and mixtures thereof.

15. The laundry pre-spotter composition as claimed in claim 10, wherein the nonionic surfactant is present in an amount of from 12.5% to about 13.0% by weight of the total composition.

16. The laundry pre-spotter composition as claimed in claim 10, wherein the polymer component is present in an amount from about 0.75% to about 1.5% by weight of the total composition.

17. The laundry pre-spotter composition as claimed in claim 10, wherein the polymer is present in an amount of from about 0.9% to about 1.3% by weight of the total composition.

18. A method of laundering, comprising the steps of:

(a) applying an effective amount of an aqueous cleaning composition to an article to be laundered, the cleaning composition comprising:

(1) from about 5.0% to about 30% by weight of at least one nonionic surfactant having an HLB value of from about 8 to about 13; and (2) from about 0.4% to about 2.0% by weight of at least one associative polymeric thickener wherein the composition provides cleaning equivalent to a composition containing about twice the amount of nonionic surfactant by weight and exhibits a viscosity of from about 500 cps to about 100,000 cps at 25° C.;

(3) amounts of an alkaline neutralizing agent effective to neutralize the polymer of (2) and adjust the pH of the composition to from 5.5 to 9.5; and (b) laundering the article.

19. The method of laundering as claimed in claim 18, wherein the nonionic surfactant is a secondary alcohol ethoxylate having about 5 moles of ethylene oxide.

20. The method of laundering as claimed in claim 18, wherein the associative polymer thickener is a methacrylate emulsion polymer.

21. The method of laundering as claimed in claim 20, wherein the methacrylate emulsion polymer comprises a 40% methacrylic acid/50% ethyl acrylate/10% stearyl oxypoly ethyl methacrylate emulsion polymer having about 20 moles of ethylene oxide.

22. A method of laundering comprising the steps of:

(a) applying an effective amount of an aqueous cleaning composition to an article to be laundered, the cleaning composition comprising:

(1) from about 10.0% to about 16.0% by weight of a nonionic surfactant having an HLB value of about 8 to about 13;

(2) from about 0.75% to about 1.5% by weight of an associative polymeric thickener, wherein the composition provides cleaning efficacy equivalent to a composition having about twice the amount of a nonionic surfactant by weight and exhibits a viscosity of from about 500 cps to about 100,000 cps at 25° C.; and (3) amounts of an alkaline neutralizing agent effective to neutralize the polymer of (2) and adjust the pH of the composition to from 5.5 to 9.5; and (b) laundering the article.

23. The method of laundering as claimed in claim 22, wherein the nonionic surfactant is a secondary alcohol ethoxylate having about 5 moles of ethylene oxide.

24. The method of laundering as claimed in claim 22, wherein the associative polymeric thickener is a methacrylate emulsion polymer.

25. The method of laundering as claimed in claim 24, wherein the methacrylate emulsion polymer is a 40% methacrylic acid/50% ethyl acrylate/10% stearyl oxypoly methacrylate emulsion polymer having about 20 moles of ethylene oxide.

26. A method of laundering, comprising the steps of:

(a) applying an effective amount of an aqueous cleaning composition to an article to be laundered, the cleaning composition comprising from about 9.0% to about 13.0% by weight of nonylphenol having about 6 moles of ethylene oxide; and about 0.9% by weight of a methacrylate emulsion polymer, 40% methacrylic acid/50% ethyl acrylate/10% stearyl having about 20 moles of ethylene oxide, wherein the composition provides cleaning efficacy equivalent to a composition containing about twice the amount of nonionic surfactant by weight and exhibits a viscosity of from about 500 cps to about 100,000 cps at 25° C.; and (b) laundering the article.

27. A method of laundering, comprising the steps of:

(a) applying an effective amount of an aqueous cleaning composition to an article to be laundered, the cleaning composition comprising:

(1) from about 5.0% to about 30% by weight of the total composition of at least one nonionic surfactant having an average HLB value of from about 8 to about 13;

(2) from about 0.4% to about 2.0% by weight of the total composition of a hydrophobically modified water soluble polymer thickening agent which when neutralized to a pH of at least 5.5 is water soluble and imparts pseudo plastic and synergistic cleaning characteristics to the detergent composition and is an addition polymer prepared from monomers comprising (i) at least one $C_3$–$C_8$ alpha-beta-monoethylenically unsaturated monocarboxylic acid or dicarboxylic acid monomer; (ii) at least one monoethylenically unsaturated copolymerizable monomer lacking surfactant capacity, and (iii) at least one monomer possessing surfactant capacity which is the reaction product of a monoethylenically unsaturated monomer with a nonionic surfactant compound wherein the monomer is copolymerizable with the monomers of (i) and (ii); and (3) an effective amount of an alkaline neutralizing agent to neutralize the polymer of (2) and render the pH of the composition in the range of about 5.5 to 9.5; wherein the composition provides cleaning efficacy equivalent to a composition containing about twice the amount of nonionic surfactant by weight and exhibits a viscosity of from about 500 cps to about 100,000 cps at 25° C.; and (b) laundering the article.

28. The method of laundering as claimed in claim 27, wherein the nonionic surfactant is a secondary alcohol ethoxylate having about 5 moles of ethylene oxide.

29. The method of laundering as claimed in claim 28, wherein the acid monomer (i) is selected from the group consisting of acrylic acid and methacrylic acid and the monomer (ii) is selected from copolymerizable monomers of the formula $H_2C{=}CYZ$ wherein either;

(a) Y is H and Z is $—COOR^1$, $—C_6H_4R^2$, CN, $—OOCR^3$, or $—CONH_2$; or (b) Y is $C_1$–$C_4$ alkyl and Z is —$COOR^1$, —$C_6H_4R^2$, CN or —$CONH_2$; and $R^1$ is $C_1$–$C_8$ alkyl; $R^2$ is H or $C_1$–$C_4$ alkyl; and $R^3$ is $C_1$–$C_8$ alkyl.

30. The method of laundering as claimed in claim 29, wherein the polymer component comprises about 30% to 60% of monomer (i); about 15–80% of monomer (ii); and about 4.0% to 20.0% of a surfactant ester of the formula $$H_2C{=}CR^4CO(OC_2H_4)_n(OCHR^5CH_2)_mOR^6$$

wherein $R^4$ is H or $CH_3$, each $R^5$ is $C_1$–$C_2$ alkyl, $R^6$ is $C_8$–$C_{30}$ alkyl or $C_8$–$C_{16}$ alkylphenyl 7, n has an average value of from about 3–40 and m has an average value of from about 0–40 provided that n is greater than or equal to m and the sum of n+m is about 3–80.

31. The method of laundering as claimed in claim 27, wherein the alkaline neutralizing agent is selected from the group consisting of sodium hydroxide, potassium hydroxide, ammonium hydroxide and mixtures thereof.

32. The method of laundering as claimed in claim 27, wherein the nonionic surfactant is present in art amount of from about 12.5% to about 13.0% by weight of the total composition.

33. The method of laundering as claimed in claim 27, wherein the polymer component is present in an amount from about 0.75%, to about 1.5% by weight of the total composition.

34. The method of laundering as claimed in claim 27, wherein the polymer is present in an amount of from about 0.9% to about 1.3% by weight of the total composition.

* * * * *